US008133956B2

(12) United States Patent
Kamino et al.

(10) Patent No.: US 8,133,956 B2
(45) Date of Patent: Mar. 13, 2012

(54) GOLF BALL

(75) Inventors: Kazuya Kamino, Kobe (JP); Keiji Ohama, Kobe (JP); Toshiyuki Tarao, Kobe (JP)

(73) Assignee: SRI Sports Limited, Kobe (JP)

( * ) Notice: Subject to any disclaimer, the term of this patent is extended or adjusted under 35 U.S.C. 154(b) by 571 days.

(21) Appl. No.: 12/343,680

(22) Filed: Dec. 24, 2008

(65) Prior Publication Data

US 2009/0170636 A1 Jul. 2, 2009

(30) Foreign Application Priority Data

Dec. 28, 2007 (JP) ..... 2007-341234

(51) Int. Cl.
*A63B 37/12* (2006.01)
*A63B 37/00* (2006.01)

(52) U.S. Cl. ..... 525/438; 525/111; 525/127; 525/129; 525/440.09; 525/454; 525/457; 473/374; 473/378

(58) Field of Classification Search ..... None
See application file for complete search history.

(56) References Cited

U.S. PATENT DOCUMENTS

| | | | | |
|---|---|---|---|---|
| 3,989,568 | A | 11/1976 | Isaac | |
| 5,271,964 | A * | 12/1993 | Ohishi | 427/386 |
| 5,334,673 | A | 8/1994 | Wu | |
| 5,908,358 | A | 6/1999 | Wu | |
| 6,123,628 | A | 9/2000 | Ichikawa et al. | |
| 6,525,124 | B1 | 2/2003 | Hiraoka et al. | |
| 6,747,100 | B2 | 6/2004 | Ichikawa et al. | |
| 6,764,415 | B2 | 7/2004 | Ichikawa et al. | |
| 7,090,799 | B2 | 8/2006 | Takesue et al. | |
| 2003/0027666 | A1 | 2/2003 | Watanabe et al. | |
| 2004/0214964 | A1 * | 10/2004 | Kim et al. | 525/454 |
| 2005/0202904 | A1 * | 9/2005 | Takesue et al. | 473/378 |
| 2008/0161128 | A1 * | 7/2008 | Manami et al. | 473/371 |
| 2009/0170636 | A1 | 7/2009 | Kamino et al. | |

FOREIGN PATENT DOCUMENTS

| | | | |
|---|---|---|---|
| JP | 51-74726 | A | 6/1976 |
| JP | 9-094311 | A | 4/1997 |
| JP | 2662909 | B2 | 6/1997 |
| JP | 11-178949 | A | 7/1999 |
| JP | 2000-513596 | A | 10/2000 |
| JP | 2002-336378 | A | 11/2002 |
| JP | 2002-336386 | A | 11/2002 |
| JP | 2005-253962 | A | 9/2005 |

OTHER PUBLICATIONS

U.S. Office Action issued on Jun. 30, 2011 in U.S. Appl. No. 12/343,558.

* cited by examiner

*Primary Examiner* — David Buttner
(74) *Attorney, Agent, or Firm* — Birch, Stewart, Kolasch & Birch, LLP

(57) ABSTRACT

The object of the present invention is to provide a golf ball which has excellent durability and wear-resistance and provides an excellent shot feeling. The present invention provides a golf ball comprising: a core consisting of a center and at least one intermediate layer covering the center; and a cover covering the core, wherein the cover is formed from a cover composition containing a thermoplastic polyurethane (A), a polyisocyanate compound (B) having at least two isocyanate groups, and a polyhydroxyether (C) as a resin component, wherein the cover composition has a slab hardness from 20 to 55 in shore D hardness, and the cover has a thickness from 0.1 mm to 1.5 mm.

18 Claims, 3 Drawing Sheets

GOLF BALL

FIELD OF THE INVENTION

The present invention relates to a golf ball having a urethane cover, and more particularly, to a golf ball which has excellent durability and wear-resistance and provides an excellent spin performance.

DESCRIPTION OF THE RELATED ART

Recently, a golf ball containing polyurethane as a resin component constituting a cover has been developed (e.g. Japanese Patent Publication No. S51-74726 A and Japanese Patent No. 2662909 B).

However, since a golf ball has insufficient durability when polyurethane is used for the cover, various technologies for improving covers containing polyurethane have been studied. For example, Japanese Patent Publication No. H11-178949 A discloses a golf ball which comprises a reaction product of a thermoplastic polyurethane elastomer and a blocked isocyanate as a main component of a resin component forming a cover. Japanese Patent Publications No. 2002-336378 A, No. 2002-336386 A, and No. 2005-253962 A disclose a golf ball having a cover which is formed from a composition containing a polyurethane material and an isocyanate mixture. Japanese Patent Publication No. 2000-513596 A discloses a golf ball having a cover being produced from a polyurethane composition containing an organic curing agent having at least one epoxy group.

Meanwhile, there are golf balls called "range balls" intended to be used mainly in driving ranges. It is known that such range balls require more excellent durability than golf balls for round games (e.g. Japanese Patent Publication No. H09-94311 A).

SUMMARY OF THE INVENTION

However, the golf balls disclosed in the above Patent Documents lack the durability, the wear-resistance, and the spin performance. The golf ball disclosed in Japanese Patent Publication No. H09-094311 A is excellent in durability but has not been studied regarding spin performance.

An object of the present invention, which has been made in view of the circumstances above, is to provide a golf ball which has excellent durability and wear-resistance and provides an excellent spin performance.

A golf ball of the present invention which has solved the above problems comprises:

a core consisting of a center and at least one intermediate layer covering the center; and a cover covering the core, wherein the cover is formed from a cover composition containing a thermoplastic polyurethane (A), a polyisocyanate compound (B) having at least two isocyanate groups, and a polyhydroxyether (C) as resin component, the cover composition has a slab hardness from 20 to 55 in shore D hardness, and the cover has a thickness from 0.1 mm to 1.5 mm.

That is, the wear-resistance and the durability of the cover as well as the spin performance of a golf ball are improved by forming the cover from a composition containing a thermoplastic polyurethane (A), a polyisocyanate compound (B), and a polyhydroxyether (C) as a resin component and having a slab hardness from 20 to 55 in Shore D hardness, and making the thickness of the cover from 0.1 mm to 1.5 mm.

Generally, if a soft material such as a thermoplastic polyurethane is used as a resin component of the cover material, the durability of the cover is improved but wear-resistance tends to be lower. However, in the present invention, since the cover composition contains the thermoplastic polyurethane (A), the polyisocyanate (B), and the polyhydroxyether (C) as a resin component, the thermoplastic polyurethane (A) as a soft material and the polyhydroxyether (C) as a hard material are crosslinked with the polyisocyanate (B). As a result, the wear-resistance of the resultant cover is considered to be improved.

Further, in the case of using a polyisocyanate mixture (B+b) where a polyisocyanate (B) is dispersed in a thermoplastic resin (b) which does not substantially react with an isocyanate group as the polyisocyanate (B), the crosslinking reaction can be suppressed during the cover molding process, and promoted after the cover molding process. Thus, the abrasion-resistance and the durability of the cover can be improved without lowering productivity of the golf ball.

The polyhydroxyether (C) preferably has a repeating structural unit represented by the following Formula (1).

[Formula 1]

(1)

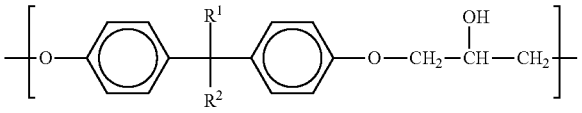

wherein $R^1$ an $R^2$ are the same or different from each other, and each are a hydrogen atom or a methyl group.

It is more preferable that the polyhydroxyether (C) is represented by the following Formula (2). Use of the polyhydroxyether represented by the following Formula (2) can further improve the wear-resistance of the cover.

[Formula 2]

(2)

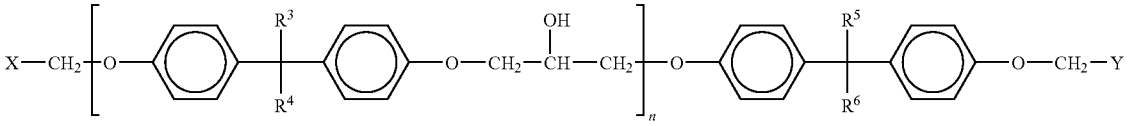

wherein $R^3$, $R^4$, $R^5$, $R^6$ are the same or different from each other, and each are a hydrogen atom or a methyl group; X and Y are the same or different from each other, and each are an epoxy group or a hydroxyethyl group; and n is a positive integer.

It is preferable that the polyhydroxyether (C) has a number average molecular weight in a range from 100 to 100,000. It is also preferable that a content of the polyhydroxyether (C) is 1 to 20 parts by mass with respect to 100 parts by mass of the thermoplastic polyurethane (A).

The intermediate layer in contact with the cover is preferably formed from a resin composition, and the intermediate layer in contact with the cover preferably has a thickness from 0.5 mm to 2.3 mm. Making the thickness of the intermediate layer in contact with the cover equal to or larger than 0.5 mm can enhance an effect of "outer-hardness and inner-softness", thereby decreasing the spin rate when hitting a driver shot. Making the thickness of the intermediate layer equal to or smaller than 2.3 mm can provide an excellent shot feeling.

The resin composition forming the intermediate layer in contact with the cover has a slab hardness from 50 to 75 in shore D hardness. Making the slab hardness of the resin composition for the intermediate layer equal to or larger than 50 in shore D hardness enhances the effect of "outer-hardness and inner-softness", thereby decreasing the spin rate when hitting a driver shot. Making the slab hardness of the resin composition for the intermediate layer equal to or smaller than 75 in shore D hardness provides an excellent shot feeling.

The present invention provides a golf ball which has excellent abrasion-resistance and durability and provides an excellent spin performance.

DESCRIPTION OF THE PREFERRED EMBODIMENT

Figure 1:
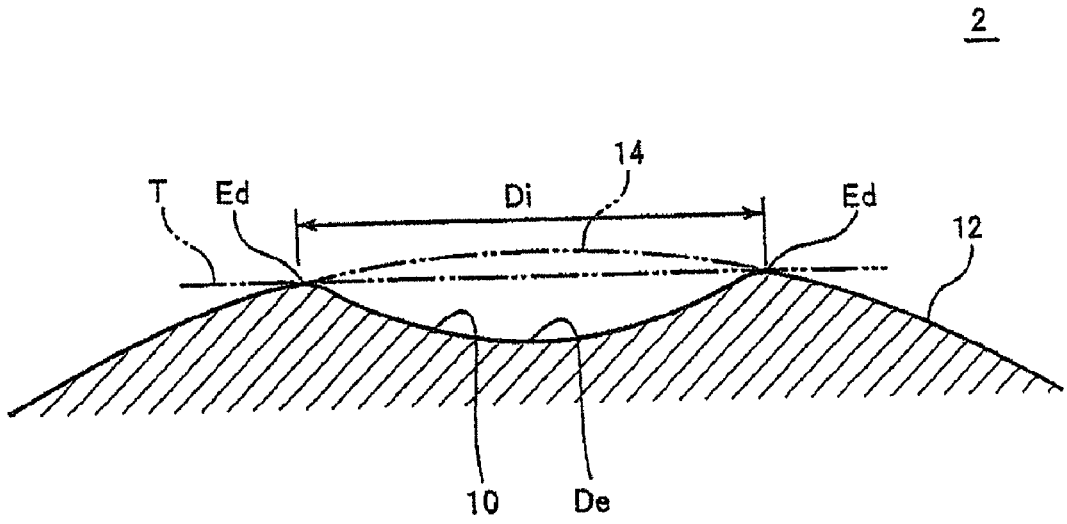
FIG. 1 is an enlarged cross-sectional view of a dimple formed on a surface of a golf ball.

The present invention provides a golf ball comprises:

a core consisting of a center and at least one intermediate layer covering the center; and a cover covering the core, wherein the cover is formed from a cover composition containing a thermoplastic polyurethane (A), a polyisocyanate compound (B) having at least two isocyanate groups, and a polyhydroxyether (C) as a resin component, the cover composition has a slab hardness from 20 to 55 in shore D hardness, and the cover has a thickness from 0.1 mm to 1.5 mm.

First, the thermoplastic polyurethane (A) will be explained. The thermoplastic polyurethane (A) used in the present invention is not particularly limited, as long as it has a plurality of urethane bonds in a molecule and exhibits thermoplasticity. For example, the thermoplastic polyurethane is a reaction product obtained by reacting a polyisocyanate with a high molecular weight polyol to form urethane bonds in a molecule thereof, where necessary, obtained by further carrying out a chain extension reaction with a chain extender such as a low-molecular weight polyol and a low-molecular weight polyamine.

The polyisocyanate component, which constitutes the thermoplastic polyurethane (A), is not limited as long as it has at least two isocyanate groups. Examples of the polyisocyanate include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene-diisocyanate (TMXDI), para-phenylene diisocyanate (PPDI); an alicyclic polyisocyanate or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). These may be used either alone or as a mixture of at least two of them.

In view of improving the abrasion-resistance, the aromatic polyisocyanate is preferably used as the polyisocyanate component of the thermoplastic polyurethane (A). A use of the aromatic polyisocyanate improves the mechanical property of the obtained polyurethane and provides the cover with the excellent abrasion-resistance. In addition, in view of improving the weather resistance, as the polyisocyanate component of the thermoplastic polyurethane (A), a non-yellowing type polyisocyanate such as TMXDI, XDI, HDI, $H_6$XDI, IPDI, $H_{12}$MDI and NBDI is preferably used. More preferably, 4,4'-dicyclohexylmethane diisocyanate ($H_{12}$MDI) is used. Since 4,4'-dicyclohexylmethane diisocyanate ($H_{12}$MDI) has a rigid structure, the mechanical property of the resulting polyurethane is improved, and thus the cover which is excellent in abrasion-resistance can be obtained.

The polyol component constituting the thermoplastic polyurethane (A) is not particularly limited as long as it has a plurality of hydroxyl groups, and such examples include a low-molecular weight polyol and a high-molecular weight polyol. Examples of the low-molecular weight polyol may include a diol such as ethylene glycol, diethylene glycol, triethylene glycol, propanediol (e.g., 1,2-propanediol, 1,3-propanediol, and 2-methyl-1,3-propanediol), dipropyleneglycol, butanediol (e.g., 1,2-butanediol, 1,3-butanediol, 1,4-butanediol, 2,3-butanediol, and 2,3-dimethyl-2,3-butanediol), neopentylglycol, pentanediol, hexanediol, heptanediol, octanediol, 1,6-cyclohexanedimethylol, an aniline diol, and bisphenol A diol; a triol such as glycerin, trimethylol propane, and hexanetriol; a tetraol or a hexanol such as pentaerythritol and sorbitol.

Examples of the high-molecular weight polyol include a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ϵ-caprolactone (PCL); apolycarbonate-polyol such as polyhexamethylene carbonate; and an acrylic polyol. The above polyols may be used alone or as a mixture of at least two of them.

A number average molecular weight of the high-molecular weight polyol is not particularly limited, and for example, it is preferably 400 or more, more preferably 1,000 or more. If the number average molecular weight of the high-molecular weight polyol is made 400 or more, the resultant polyurethane does not become too hard and the shot feeling of the golf ball is improved. The upper limit of the number average molecular weight of the high molecular weight polyol is not particularly limited, and it is preferably 10,000, more preferably 8,000. The number average molecular weight of the polyol component can be measured by Gel permeation Chromatography using two columns of TSK-GEL SUPREH 2500 (TOSOH Corporation) as a column, polystyrene as a standard material, and tetrahydrofuran as an eluate.

The high-molecular weight polyol, used as the polyol component, has a hydroxyl value of 150 mgKOH/g or less, more preferably 120 mgKOH/g or less, even more preferably 60 mgKOH/g or less. The hydroxyl value of the high molecular weight polyol can be measured for example, by an acetylation method according to JIS K1557-1.

The polyamine component that constitutes the thermoplastic polyurethane where necessary may include any polyamine, as long as it has at least two amino groups. The polyamine includes an aliphatic polyamine such as ethylenediamine, propylenediamine, butylenediamine, and hexamethylenediamine, an alicyclic polyamine such as isophoronediamine, piperazine, and an aromatic polyamine.

The aromatic polyamine has no limitation as long as it has at least two amino groups directly or indirectly bonded to an aromatic ring. Herein, the "indirectly bonded to the aromatic ring", for example, means that the amino group is bonded to the aromatic ring via a lower alkylene bond. Further, the aromatic polyamine includes, for example, a monocyclic aromatic polyamine having at least two amino groups bonded to one aromatic ring or a polycyclic aromatic polyamine having at least two aminophenyl groups each having at least one amino group bonded to one aromatic ring.

Examples of the monocyclic aromatic polyamine include a type such as phenylenediamine, tolylenediamine, diethyltoluenediamine, and dimethylthiotoluenediamine wherein amino groups are directly bonded to an aromatic ring; and a type such as xylylenediamine wherein amino groups are bonded to an aromatic ring via a lower alkylene group. Further, the polycyclic aromatic polyamine may include a poly (aminobenzene) having at least two aminophenyl groups directly bonded to each other or a compound having at least two aminophenyl groups bonded via a lower alkylene group or an alkylene oxide group. Among them, a diaminodiphenylalkane having two aminophenyl groups bonded to each other via a lower alkylene group is preferable. Typically preferred are 4,4'-diaminodiphenylmethane or the derivatives thereof.

The thermoplastic polyurethane (A) has no limitation on the constitutional embodiments thereof. Examples of the constitutional embodiments are the embodiment where the polyurethane consists of the polyisocyanate component and the high-molecular weight polyol component; the embodiment where the polyurethane consists of the polyisocyanate component, the high-molecular weight polyol component and the low-molecular weight polyol component; and the embodiment where the polyurethane consists of the polyisocyanate component, the high-molecular weight polyol component, the low-molecular weight polyol component, and the polyamine component; and the embodiment where the polyurethane consists of the polyisocyanate component, the high-molecular weight polyol component and the polyamine component.

The thermoplastic polyurethane (A) preferably has a slab hardness in shore D hardness of 20 or larger, and more preferably 26 or larger, and preferably has a slab hardness in shore D hardness of 55 or smaller, and more preferably 52 or smaller, and even more preferably 49 or smaller. Making the hardness of the thermoplastic polyurethane (A) equal to or larger than 20 in shore D hardness prevents the cover composition from becoming too soft, thereby obtaining excellent resilient performance of the golf ball. Making the hardness of the thermoplastic polyurethane (A) equal to or smaller than 55 in shore D hardness prevents the cover from becoming too hard, thereby obtaining sufficient durability of the cover. Specific examples of the thermoplastic polyurethane (A) are "Elastollan (registered trademark) 1195ATR, Elastollan ET880, Elastollan 1198ATR, and Elastollan 1154D" available from BASF Japan Ltd.

The following will describe the polyisocyanate (B) having at least two isocyanate groups.

The polyisocyanate (B) is not limited, as long as it has two or more isocyanate groups. Examples of the polyisocyanate (B) include a diisocyanate, a triisocyanate, and an isocyanate-containing urethane prepolymer. As the polyisocyanate (B), preferably used is a polyisocyanate mixture (B+b) where the polyisocyanate (B) is dispersed into a thermoplastic resin (b) which does not substantially react with an isocyanate group.

Examples of the diisocyanate include 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylenediisocyanate (TMXDI), para-phenylene diisocyanate (PPDI), 4,4'-dicyclohexylmethane diisocyanate ($H_{12}MDI$), hydrogenated xylylenediisocyanate ($H_6XDI$), hexamethylene diisocyanate (HDI), isophorone diisocyanate (IPDI), and norbornene diisocyanate (NBDI).

Examples of the triisocyanate include a trifunctional isocyanate such as triphenyl methane triisocyanate, tris(isocyanatephenyl)thiophosphate, lysinestertriisocyanate, 1,6,11-undecane triisocyanate, 1,8-diisocyanate-4-isocyanate methyloctane, 1,3,6-hexamethylene triisocyanate, and bicycloheptane triisocyanate; isocyanurate of diisocyanate such as hexamethylene diisocyanate (HDI) and hydrogenated xylylene diisocyanate ($H_6XDI$); an adduct obtained by reacting diisocyanate with a triol having a low-molecular weight such as trimethylol propane or glycerin (tree diisocyanate are preferably removed from the adduct); an allophanate modified polyisocyanate; a biuret modified polyisocyanate, and the like. The allophanate modified polyisocyanate is, for example, a trifunctional polyisocyanate obtained by reacting diisocyanate with a diol having a low-molecular weight to form a urethane bond and further reacting the urethane bond with the diisocyanate, and the biuret modified polyisocyanate is, for example, a trifunctional polyisocyanate obtained by reacting a diisocyanate with a diamine having a low molecular weight to form a urea bond and further reacting the urea bond with the diisocyanate.

The triisocyanate used in the present invention has a molecular weight of preferably 200 or larger, more preferably 350 or larger, and even more preferably 500 or larger, and preferably 2,500 or smaller, more preferably less than 2,000, even more preferably less than 1,500, and much more preferably less than 1,000. The molecular weight of the triisocyanate can be obtained, for example, by gel permeation chromatography.

The isocyanate-containing urethane prepolymer is not particularly limited, as long as it is a compound having a plurality of urethane bonds and two or more isocyanate groups in a molecule thereof, and having a lower molecular weight than that of the thermoplastic polyurethane (A). Such examples include an isocyanate group-terminated urethane prepolymer having urethane bonds formed in a molecule thereof by, for example, reacting a polyisocyanate and a polyol under a condition wherein the polyisocyanate is in excess. The blending ratio of the polyisocyanate component to the polyol component is preferably 1.1 or more, more preferably 1.2 or more, even more preferably 1.3 or more, and is preferably 3.0 or less, more preferably 2.5 or less, even more preferably 2.0 or less in a molar ratio (NCO/OH) of the isocyanate group (NCO) of the polyisocyanate component to the hydroxyl group (OH) of the polyol component.

The polyisocyanate component used as a raw material for the isocyanate-containing urethane prepolymer is not limited, as long as the polyisocyanate has at least two isocyanate groups. Examples of the polyisocyanate component include polyisocyanates exemplified as the polyisocyanate constituting the thermoplastic polyurethane (A). The polyol component used as a raw material for the isocyanate-containing urethane prepolymer is not limited, as long as the polyol component has a plurality of hydroxyl groups. Examples of the polyol component include polyols such as a high-molecular weight polyol and a low-molecular weight polyol exemplified as the polyol component constituting the thermoplastic polyurethane (A).

The isocyanate group-terminated urethane prepolymer used as the isocyanate-containing urethane prepolymer includes TDI based urethane prepolymer, MDI based urethane prepolymer, and $H_{12}$MDI based urethane prepolymer. Preferably used is MDI based urethane prepolymer or $H_{12}$MDI based urethane prepolymer. Herein, TDI based urethane prepolymer means an isocyanate group terminated urethane prepolymer obtained by reacting TDI or a polyisocyanate compound containing TDI as a main component with a polyol (preferably PTMG); MDI based urethane prepolymer means an isocyanate group terminated urethane prepolymer obtained by reacting MDI or a polyisocyanate compound containing MDI as a main component with a polyol (preferably PTMG), and $H_{12}$MDI based urethane prepolymer means an isocyanate group terminated urethane prepolymer obtained by reacting $H_{12}$MDI or a polyisocyanate compound containing $H_{12}$MDI with a polyol (preferably PTMG).

For a reaction between the polyisocyanate component and the polyol component, a catalyst which is publicly known for being used in the urethane reaction can be used. Examples of the catalyst include a monoamine such as triethylamine and N,N-dimethylcyclohexylamine; a polyamine such as N,N,N',N'-tetramethylethylenediamine and N,N,N',N'',N''-pentamethyldiethylenetriamine; a cyclic diamine such as 1,8-diazabicyclo[5,4,0]-7-undecene (DBU) and triethylenediamine; a tin catalyst such as dibutyltin dilaurylate and dibutyltin diacetate; an organic carboxylic acid such as acetic acid, azelaic acid, oleic acid and adipic acid.

A number average molecular weight of the urethane prepolymer is preferably, for example, 1,000 or more, more preferably 1,500 or more, even more preferably 2,000 or more, and is preferably 30,000 or less, more preferably 20,000 or less, even more preferably 10,000 or less. If the number average molecular weight is 1,000 or more, a distance between crosslinking points in the crosslinking reaction becomes longer, so that the resultant polyurethane cover does not become too hard, thereby improving durability thereof. On the other hand, if the number average molecular weight is 30,000 or less, the crosslinking density does not become too low, so that the abrasion-resistance of the resultant cover is improved.

The isocyanate content (NCO %) in the polyisocyanate (B) is preferably 0.5 mass % or higher and preferably 45 mass % or lower. Making the isocyanate content in the polyisocyanate (B) equal to or higher than 0.5 mass % provides a sufficient crosslinking effect, thereby improving the abrasion-resistance of the resulting cover. If the isocyanate content in the polyisocyanate (B) is too large, the viscosity of the cover composition excessively increases, thereby causing a possibility that moldability will deteriorate. The isocyanate content (NCO %) in the polyisocyanate (B) can be represented as: 100×(number of moles of isocyanate groups in the polyisocyanate (B)×42 (the molecular weight of NCO))/(the total mass of the polyisocyanate (B)).

Especially, when the diisocyanate is used as the polyisocyanate (B), the isocyanate content (NCO %) in the polyisocyanate (B) is preferably 15 mass % or higher, more preferably 17.5 mass % or higher, and evenmore preferably 20 mass % or higher, and is preferably 45 mass % or lower, more preferably 42.5 mass % or lower, and even more preferably 40 mass % or lower.

When the triisocyanate is used as the polyisocyanate (B), the isocyanate content (NCO %) in the polyisocyanate (B) is preferably 10 mass % or higher, more preferably 12.5 mass % or higher, and even more preferably 15 mass % or higher, and is preferably 30.0 mass % or lower, more preferably 27.0 mass % or lower, and even more preferably 25.0 mass % or lower.

When the urethane prepolymer is used as the polyisocyanate (B), the isocyanate content (NCO %) in the polyisocyanate (B) is preferably 0.5 mass % or higher, more preferably 0.75 mass % or higher, and even more preferably 1.0 mass % or higher, and is preferably less than 10.0 mass %, more preferably 9.0 mass % or lower, even more preferably 6.0 mass % or lower, and much more preferably 3.0 mass % or lower.

The thermoplastic resin (b) which does not substantially react with an isocyanate group is not particularly limited as long as it is substantially inactive with an isocyanate group (That is, the thermoplastic resin (b) does not substantially have an active hydrogen reactive with an isocyanate group), and such examples include a polystyrene resin, a polyvinylchloride resin, an acrylic resin, an ABS resin, an ester rubber, a polycarbonate resin, a polyester resin (preferably polyethylene terephthalate), polyolefin, polyacetal, a difluoride resin, a tetrafluoride resin, and an ionomer resin. Among them, as the thermoplastic resin (b), a thermoplastic elastomer having rubber elasticity is preferable. For example, it is preferred to use at least one kind selected from the group consisting of a polyester elastomer, an acrylic elastomer, a styrene elastomer, an olefin elastomer, and a vinyl chloride elastomer. Examples of the polyester elastomer include "HYTREL" such as "HYTREL 3046", "HYTREL 3548" and "HYTREL 4047" manufactured by DU PONT-TORAY Co or "Primalloy" such as "Primalloy A 1500" manufactured by Mitsubishi Chemical Corporation, and examples of the styrene elastomer include "Rabalon" manufactured by Mitsubishi Chemical Corporation.

In the polyisocyanate mixture (B+b), a blending ratio of the polyisocyanate (B) to the thermoplastic resin (b) (a total of 100 mass %) is preferably: the polyisocyanate (B)/thermoplastic resin (b)=5 mass % to 50 mass %/50 mass % to 95 mass %, more preferably 10 mass % to 50 mass %/50 mass % to 90 mass %, even more preferably 20 mass % to 45 mass %/55 mass % to 80 mass %. If the blending ratio is outside the above range, a desired crosslinking structure may not be obtained, or the durability may be deteriorated due to the too high crosslinking degree.

The isocyanate content (NCO %) in the polyisocyanate mixture (B+b) can be represented as: 100×(number of moles of isocyanate groups in the polyisocyanate mixture (B+b)×42 (the molecular weight of NCO))/the total mass (g) of the polyisocyanate mixture (B+b). The isocyanate content (NCO %) in the polyisocyanate mixture (B+b) is preferably 0.025 mass % or higher, and 22.5 mass % or lower. If the isocyanate content (NCO %) in the polyisocyanate mixture (B+b) is smaller than the above range, a crosslinking effect may not be obtained, thereby deteriorating the abrasion-resistance of the cover. If the isocyanate content (NCO %) in the polyisocyanate mixture (B+b) is larger than the above range, the viscosity of the cover composition excessively increases, thereby causing a possibility that the moldability will deteriorate.

Especially, when the diisocyanate is used as the polyisocyanate (B), the isocyanate content (NCO %) in the polyisocyanate mixture (B+b) is preferably 0.075 mass % or higher, more preferably 0.90 mass % or higher, and even more preferably 1.5 mass % or higher, and is preferably 21 mass % or lower, more preferably 19 mass % or lower, and even more preferably 17 mass % or lower.

When the triisocyanate is used as the polyisocyanate (B), the isocyanate content (NCO %) in the polyisocyanate mixture (B+b) is preferably 5.0 mass % or higher, more preferably 7.0 mass % or higher, and even more preferably 8.5 mass % or higher, and preferably 30.0 mass % or lower, more preferably 20.0 mass % or lower, and even more preferably 12.0 mass % or lower.

When the urethane prepolymer is used as the polyisocyanate (B), the isocyanate content (NCO %) in the polyisocyanate mixture (B+b) is preferably 0.1 mass % or higher, more preferably 0.2 mass % or higher, and even more preferably 0.3 mass % or higher, and preferably 10.0 mass % or lower, more preferably 7.0 mass % or lower, and even more preferably 5.0 mass % or lower.

Examples of the polyisocyanate mixture (B+b) include "Crossnate EM-30" available from Dainichiseika Color & Chemicals Mfg. Co., Ltd.

The content of the polyisocyanate mixture (B+b) in the cover composition used in the present invention is preferably 1 part by mass or larger, more preferably 2 parts by mass or larger, and even more preferably 4 parts by mass or larger, and is preferably 20 parts by mass or smaller, more preferably 18 parts by mass or smaller, and even more preferably 15 parts by mass or smaller with respect to 100 parts by mass of the thermoplastic polyurethane (A). Making the content of the polyisocyanate mixture (B+b) within the above range prevents the crosslinking density from becoming too high and provides a sufficient crosslinked structure, thereby improving the durability of the cover.

The following will describe the polyhydroxyether (C). The polyhydroxyether (C) used in the present invention is not limited, as long as it has a plurality of ether bonds and at least two hydroxyl groups within a molecule.

Examples of the polyhydroxyether (C) include a polyether glycol such as polyoxyethylene glycol (PEG), polyoxypropylene glycol (PPG), and polyoxytetramethyleneglycol (PTMG); and an epoxy resin having two or more hydroxyl groups within the molecule. The polyhydroxyether (C) may be used solely, or in combination of at least two of them.

The polyhydroxyether (C) preferably has a repeating structural unit represented by the following Formula (1).

[Formula 1]

(1)

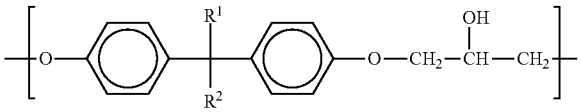

wherein $R^1$ an $R^2$ are the same or different from each other, and each are a hydrogen atom or a methyl group.

Using the polyhydroxyether (C) having the repeating structural unit represented by the above Formula (1) improves mechanical characteristics of the resulting cover composition, thereby obtaining a cover which has more excellent abrasion-resistance and durability.

In a more preferable embodiment, the polyhydroxyether (C) is represented by the following Formula (2).

[Formula 2]

(2)

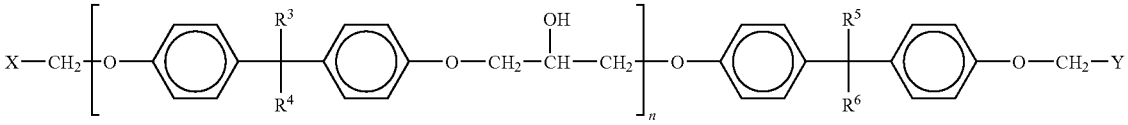

wherein $R^3$, $R^4$, $R^5$, $R^6$ are the same or different from each other, and each are a hydrogen atom or a methyl group; X and Y are the same or different from each other, and each are an epoxy group or a hydroxyethyl group; and n is a positive integer.

Examples of the polyhydroxyether (C) represented by the above Formula (2) include an epoxy resin such as bisphenol A type resin obtained by reacting bisphenol A with an epichlorohydrin, bisphenol F type resin obtained by reacting bisphenol F with an epichlorohydrin, and bisphenol AD type resin obtained by reacting bisphenol AD with an epichlorohydrin.

The polyhydroxyether (C) used in the present invention preferably has a number average molecular weight of 100 or larger, more preferably 300 or larger, and preferably has a number average molecular weight of 100,000 or smaller, and more preferably 80,000 or smaller. When the number average molecular weight of the polyhydroxyether (C) is equal to or larger than 100, the polyhydroxyether (C) has a sufficient amount of hydroxyl groups, and thus a sufficient crosslinking effect is obtained, thereby improving the wear-resistance of the cover. On the other hand, when the number average molecular weight of the polyhydroxyether (C) is equal to or smaller than 100,000, an amount of hydroxyl groups in the polyhydroxyether (C) is not excessive, and the crosslinking density does not become too high. Thus, the cover is not hard and fragile, thereby improving the durability of the cover.

When the epoxy resin is used as the polyhydroxyether (C), the polyhydroxyether (C) preferably has an epoxy equivalent of 1,000 g/eq or larger, more preferably 1,500 g/eq or larger, and even more preferably 2,000 g/eq or larger, and preferably has an epoxy equivalent of 20,000 g/eq or smaller, more preferably 15,000 g/eq or smaller, and even more preferably 10,000 g/eq or smaller. Herein, the epoxy equivalent is gram of resin containing 1 g equivalent of epoxy group, and has a value measured according to JIS K7236 standard.

Examples of the epoxy resin used as the polyhydroxyether (C) include a low-molecular-weight epoxy resin and a phenoxy resin. Herein, the phenoxy resin is a typical epoxy resin produced from an epichlorohydrin and a bisphenol among epoxy resins and having a relatively high molecular weight. The low-molecular-weight epoxy resin in the present invention preferably has a number average molecular weight of 1,000 or larger, more preferably 1,500 or larger, and preferably has a number average molecular weight of 8,000 or smaller, and more preferably 5,000 or smaller. The phenoxy resin in the present invention preferably has a weight average molecular weight of 10,000 or larger, more preferably 20,000 or larger, and preferably has a weight average molecular weight of 100,000 or smaller, and more preferably 80,000 or smaller.

Specific examples of the polyhydroxyether (C) include a solid-type epoxy resin having an epoxy equivalent of 1,750 g/eq to 3,300 g/eq such as "Epikote (registered trademark) 1007, 1009" available from Japan Epoxy Resins Co., Ltd., and a phenoxy-type epoxy resin having an epoxy equivalent of 7,000 g/eq to 8,500 g/eq such as "Epikote 1256".

The content of the polyhydroxyether (C) in the cover composition is preferably 1 part by mass or larger, more preferably 2 parts by mass or larger, and even more preferably 4 parts by mass or larger, and is preferably 20 parts by mass or smaller, more preferably 15 part by mass or smaller, and even more preferably 10 parts by mass or smaller with respect to 100 parts by mass of the thermoplastic polyurethane (A). Making the content of the polyhydroxyether (C) is equal to or larger than 1 part by mass provides a sufficient crosslinking effect, thereby improving the wear-resistance of the cover. On the other hand, making the content of the polyhydroxyether (C) equal to or smaller than 20 parts by mass provides sufficient resilient performance of the golf ball, because the content of the thermoplastic polyurethane (A) is not decreased relatively.

As the resin component, in addition to the thermoplastic polyurethane (A), the polyisocyanate (B), and the polyhydroxyether (C), another resin component can be added as long as it does not impair the effect of the present invention. However, in present invention, it is preferable that the cover composition essentially consists of the thermoplastic polyurethane (A), the polyisocyanate (B) having at least two isocyanate groups, and the polyhydroxyether (C) as the resin component.

Examples of the other resin component include an ionomer resin and a thermoplastic elastomer. Examples of the ionomer resin include one prepared by neutralizing at least a part of carboxyl groups in a copolymer composed of ethylene and α,β-unsaturated carboxylic acid having a carbon number of 3 to 8 with a metal ion; one prepared by neutralizing at least a part of carboxyl groups in a terpolymer composed of ethylene, α,β-unsaturated carboxylic acid having a carbon number of 3 to 8, and α,β-unsaturated carboxylic acid ester with a metal ion; and a mixture of these two. Specific examples of the ionomer resin include "HIMILAN (registered trademark)" available from DU PONT-MITSUI POLYCHEMICALS CO., LTD. "Surlyn (registered trademark)" available from E.I. du Pont de Nemours and Company and "Iotek (registered trademark)" available for ExxonMobile Chemical. Specific examples of the thermoplastic elastomer include a thermoplastic polyamide elastomer having a commercial name of "Pebax (registered trademark) (e.g. "Pebax 2533")" available from Arkema Inc., a thermoplastic polyester elastomer having a commercial name of "Hytrel (registered trademark) (e.g. "Hytrel 3548", "Hytrel 4047")" available from DU PONT-TORAY CO., LTD. or a commercial name of "Primalloy (registered trademark) (e.g. "Primalloy A1500")" available from Mitsubishi Chemical Corporation, and a thermoplastic polystyrene elastomer having a commercial name of "Rabalon (registered trademark)" available from Mitsubishi Chemical Corporation.

The cover composition used in the present invention may contain, other than the above-mentioned resin component, a pigment component such as titanium oxide and a blue pigment, a gravity adjusting agent such as calcium carbonate and barium sulfate, a dispersant, an antioxidant, an ultraviolet absorber, a light stabilizer, a fluorescent material or a fluorescent brightener to the extent that the cover performance is not damaged.

The content of the white pigment (titanium oxide) is preferably 0.5 part by mass or more, more preferably 1 part by mass or more, and preferably 10 parts by mass or less, more preferably 8 parts by mass or less based on 100 parts by mass of the thermoplastic polyurethane (A) constituting the cover. The white pigment in an amount of 0.5 part by mass or more can impart opacity to the cover, while the white pigment in an amount of more than 10 parts by mass may lower the durability of the resulting cover.

The cover composition used for the present invention preferably has a slab hardness in shore D hardness of 20 or larger, more preferably 23 or larger, and even more preferably 26 or larger. If the cover composition has a slab hardness of less than 20 in Shore D hardness, the effect of the outer-hardness and inner-softness is not obtained, resulting in the increase in spin rate at the driver shot. On the other hand, the cover composition used for the present invention preferably has a slab hardness in shore D hardness of 55 or smaller, more preferably 52 or smaller, and even more preferably 49 or smaller. If the cover composition has a slab hardness lager than 55 in Shore D hardness, the spin rate at the approach shot with a short iron becomes low and thus, the controllability at the approach shot is lowered. Herein, the slab hardness of the cover means the hardness when measuring the hardness of the cover composition which is formed into a sheet, and the measuring method is described later.

In the method for preparing the golf ball of the present invention, the thermoplastic polyurethane (A) and the polyisocyanate (B) and the polyhydroxyether (C) are blended to obtain a cover composition. The blending of the cover composition is preferably carried out using, for example, a mixer capable of blending a raw material in the form of pellet, more preferably a tumbler type mixer. An embodiment of blending the cover composition include, for example, an embodiment of mixing an additive for the cover such as titanium oxide with the thermoplastic polyurethane (A) and subjecting the resultant mixture to extrusion to prepare a white pellet in advance, and then dry-blending the white pellet, the polyisocyanate (B) and the polyhydroxyether (C); an embodiment of mixing the polyisocyanate (B) and the additive for a cover such as titanium oxide, and subjecting the resultant mixture to extrusion to prepare a white pellet in advance and then dry-blending the white pellet, the thermoplastic polyurethane (A) and the polyhydroxyether (C); and an embodiment of mixing the thermoplastic polyurethane (A), the polyisocyanate (B), the polyhydroxyether (C) and the additive for a cover such as titanium oxide and subjecting the resultant mixture to extrusion to prepare a white pellet in advance.

An embodiment for molding a cover is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding). In the case that the cover composition is subjected to injection molding onto the core, it is preferred to use upper and lower molds for forming a cover having a spherical cavity and pimples, wherein a part of the pimple also serves as a retractable hold pin. When forming the cover by injection molding, the hold pin is protruded to hold the core, and the cover composition which has been heated and melted is charged and then cooled to obtain a cover. For example, the cover composition heated and melted at the temperature of 150° C. to 230° C. is charged into a mold held under the pressure of 980 KPa to 1,500 KPa for 0.1 to 1 second. After cooling for 15 to 60 seconds, the mold is opened and the golf ball with the cover molded is taken out from the mold.

Molding of the half shell can be performed by either compression molding method or injection molding method, and the compression molding method is preferred. The compression-molding of the cover composition into half shell can be carried out, for example, under a pressure of 1 MPa or more and 20 MPa or less at a temperature of −20° C. or more and 70° C. or less relative to the flow beginning temperature of the cover composition. By performing the molding under the above conditions, a half shell having a uniform thickness can be formed. Examples of a method for molding the cover using half shells include compression molding by covering the core with two half shells. The compression molding of half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a cover for a golf ball having a uniform thickness can be formed. The crosslinking can be further promoted by post-curing the golf ball having the molded cover at the temperature of 40° C. or more for 4 hours to 96 hours.

In the present invention, use of the thermoplastic polyurethane (A) and the polyisocyanate (B), and the polyhydroxyether (C) suppresses the crosslinking reaction when molding the cover, and promotes the crosslinking reaction after molding the cover, thereby improving the abrasion-resistance of the cover without sacrificing the productivity of the golf ball. The crosslinking of the cover can be confirmed by the following method.

The thermoplastic polyurethane (A) crosslinked with the polyisocyanate (B) and the polyhydroxyether (C) is insoluble in the solvent in which the linear thermoplastic polyurethane (A) is soluble. The solvent in which the linear thermoplastic polyurethane (A) is soluble includes, for example, N,N-dimethylformamide (DMF), tetrahydrofuran (THF) or the like. Namely, the thermoplastic polyurethane (A) without being crosslinked is readily soluble in the solvent, but the thermoplastic polyurethane (A) crosslinked with the polyisocyanate (B) and the polyhydroxyether (C) is insoluble in the solvent. According to this difference, it is possible to confirm whether the thermoplastic polyurethane is crosslinked or not.

After the cover is molded, the mold is opened and the golf ball body is taken out from the mold, and as necessary, the golf ball body is preferably subjected to surface treatment such as deburring, cleaning, and sandblast. If desired, a paint film or a mark may be formed. There are no limitations on the thickness of the paint film, but the thickness is preferably 5 μm or larger, and more preferably 7 μm or larger, and preferably 25 μm or smaller, and more preferably 18 μm or smaller. This is because if the thickness is smaller than 5 μm, the paint film is easy to wear off due to continued use of the golf ball, and if the thickness is larger than 25 μm, the effect of dimples is reduced, resulting in deteriorating the flying performance of the golf ball.

In the present invention, the cover of the golf ball has a thickness of 0.1 mm or larger, more preferably 0.2 mm or larger, even more preferably 0.3 mm or larger. If the thickness of the cover is less than 0.1 mm, the spin rate at an approach shot with a short iron becomes low, and thus the controllability at the approach shot is lowered. On the other hand, the cover of the golf ball has a thickness of 1.5 mm or smaller, more preferably 1.3 mm or smaller, even more preferably 1.2 mm or smaller. If the thickness of the cover is lager than 1.5 mm, the effect of the outer-hard and inner-soft structure is not obtained and thus, the spin rate at the driver shot increases.

When molding a cover, the concave portions called "dimple" are usually formed on the surface. FIG. 1 is an expanded sectional view of a part of a golf ball 2. This figure shows a cross-section which includes the deepest part De of a dimple 10 and the center of the golf ball 2. The up and down direction in FIG. 1 is the depth direction of the dimple 10. The depth direction is the direction from the gravity center of the area of the dimple 10 to the center of the golf ball 2. A chain double-dashed line 14 in FIG. 1 shows a virtual sphere. The surface of the virtual sphere 14 is the surface of the golf ball 2 in the case of assuming that there is no dimple 10. The dimple 10 is depressed in the virtual sphere 14. A land 12 corresponds to the virtual sphere 14.

Two headed arrow Di in FIG. 1 shows the diameter of the dimple 10. The diameter Di is the distance from one contact point Ed to another contact point Ed when a common tangent line T is drawn in both sides of the dimple 10. The contact points Ed are edges of the dimple 10. The edges Ed define the outline of the dimple 10. The diameter Di is preferably 2.0 mm or more and 6.0 mm or less. If the diameter Di is less than the above range, the dimple effect is hardly obtained and if the diameter Di exceeds 6.0 mm, the intrinsic property of the golf ball 2, that is, it is substantially spherical, is lost.

The area s of the dimple 10 is the area surrounded by the edge line in the case the center of the golf ball 2 is observed from infinity (that is, a plane area). The areas can be calculated according to a formula: $s=(Di/2)^2\times\pi$. The ratio of the total of the area s of all the dimples 10 occupying the surface area of the virtual sphere 14 is called as an occupation ratio. The occupation ratio is preferably 75% or higher from a viewpoint that a sufficient dimple effect can be obtained.

The volume of the dimple means the volume of the portion surrounded with the curved plane including the outline of the dimple 10 and the virtual sphere 14. The total volume of the dimples 10 is preferably 250 $mm^3$ or more and 400 $mm^3$ or less. If the total volume is less than 250 $mm^3$, a hopping trajectory may be provided in some cases. If the total volume exceeds 400 $mm^3$, a dropping trajectory may possibly be provided.

In FIG. 1, the distance between the tangent line T and the deepest point De is the depth of the dimple 10. The depth is preferably 0.05 mm or more and 0.60 mm or less. If the depth is less than 0.05 mm, a hopping trajectory may be provided in some cases. On the other hand, if the depth exceeds 0.60 mm, a dropping trajectory may possibly be provided. The total number of the dimples 10 is preferably 200 or more and 500 or less. If the total number is less than 200, the dimple effect is hardly obtained. On the other hand, if the total number exceeds 500, the dimple effect is hardly obtained because the size of the respective dimples 10 is small.

The following will describe the core of the golf ball of the present invention. The core used in the golf ball of the present invention consists of a center and at least one intermediate layer covering the center.

The core of the golf ball of the present invention includes a two-piece core consisting of a center and a single-layered intermediate layer covering the center, a multi-layered core consisting of a center and multi-piece or multi-layer of intermediate layers covering the center. The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs. For example, the surface of the spherical center is evenly divided by the ribs. In one embodiment, the ribs are preferably formed on the surface of the spherical center in an integrated manner, and in another embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east (west), assuming that the meridian as the standard is at longitude 0 degrees. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

The core of the golf ball of the present invention has a diameter of preferably 40.0 mm or larger, more preferably 40.6 mm or larger, even more preferably 41.2 mm or larger. Making the diameter of the core equal to or larger than 40.0 mm prevents the cover from becoming too thick, thereby obtaining excellent resilience of the golf ball. Further, the core has a diameter of preferably 42.6 mm or smaller, more preferably 42.4 mm or smaller, and even more preferably 42.2 mm or smaller. Making the diameter of the core equal to or smaller than 42.6 mm makes the cover thick enough to obtain a protection effect by the cover.

The core has a center hardness Ho in shore D hardness of preferably 30 or larger, more preferably 33 or larger, even more preferably 36 or larger. Making the center hardness Ho of the core equal to or larger than 30 in shore D hardness prevents the core from becoming too soft, thereby obtaining excellent resilience of the golf ball. Further, the core has a center hardness Ho in shore D hardness of preferably 55 or smaller, more preferably 52 or smaller, and even more preferably 49 or smaller. Making the center hardness Ho of the core equal to or smaller than 55 in shore D hardness prevents the core from becoming too hard, thereby obtaining an excellent shot feeling. In the present invention, the center hardness Ho of the core means the hardness measured with the Shore D type spring hardness tester at the central point of a cut plane of a core which has been cut into two halves.

The core has a surface hardness Hs in shore D hardness of preferably 45 or larger, more preferably 48 or larger, and even more preferably 51 or larger. Making the surface hardness of the core equal to or larger than 45 prevents the core from becoming too soft, thereby obtaining excellent resilience of the golf ball. Further, the core has a surface hardness Hs in shore D hardness of preferably 70 or smaller, more preferably 67 or smaller, and even more preferably 64 or smaller. Making the surface hardness Hs of the core equal to or smaller than 70 in shore D hardness prevents the core from becoming too hard, thereby obtaining an excellent shot feeling.

The hardness difference (Hs−Ho) between the surface hardness Hs and the center hardness Ho of the core in shore D hardness is preferably 10 or larger, more preferably 12 or larger, and even more preferably 14 or larger, and is preferably 28 or smaller, more preferably 26 or smaller, and even more preferably 24 or smaller. Making the hardness difference (Hs−Ho) equal to or smaller than 28 allows the intermediate layer to follow deformation of the core, thereby improving the durability of the golf ball. On the other hand, making the hardness difference (Hs−Ho) equal to or larger than 10 increases the "outer-hardness and inner softness" level of the core, thereby providing a high launch angle and a low spin rate and hence increasing flight distance of the golf ball.

As the core of the golf ball of the present invention, a conventionally known rubber composition (hereinafter simply referred to as "core rubber composition" occasionally) may be employed, and it can be molded by, for example, heat-pressing a rubber composition containing a base rubber, a crosslinking initiator, a co-crosslinking agent, and a filler. The core preferably has a spherical shape. This is because if the core has a shape other than a spherical shape, the thickness of the cover becomes uneven. As a result, some portions where the cover performance is lowered may be generated.

As the base rubber, a natural rubber and/or a synthetic rubber such as a polybutadiene rubber, a natural rubber, a polyisoprene rubber, a styrene polybutadiene rubber, and ethylene-propylene-diene terpolymer (EPDM) may be used. Among them, typically preferred is the high cis-polybutadiene having cis-1,4 bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.1 part by mass or more, more preferably 0.3 part by mass or more, even more preferably 0.5 part by mass or more, and is preferably 3 parts by mass or less, more preferably 2.8 parts by mass or less, even more preferably 2.5 parts by mass or less based on 100 parts by mass of the base rubber. If the amount is less than 0.1 part by mass, the core becomes too soft, and the resilience tends to be lowered, and if the amount is more than 3 parts bymass, the core becomes too hard, and the shot feeling may be lowered.

The co-crosslinking agent is not particularly limited as long as it has the effect of crosslinking a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience.

The amount of the co-crosslinking agent to be used is preferably 10 parts or more, more preferably 15 parts or more, and is preferably 50 parts or less, more preferably 45 parts or less based on 100 parts of the base rubber by mass. If the amount of the co-crosslinking agent to be used is less than 10 parts by mass, the amount of the organic peroxide must be increased to obtain an appropriate hardness, which tends to lower the resilience. On the other hand, if the amount of the co-crosslinking agent to be used is more than 50 parts by mass, the center becomes too hard, so that the shot feeling may be lowered.

The filler contained in the rubber composition for the core is mainly blended as a gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 2 parts or more, more preferably 3 parts or more, and preferably 50 parts or less, more preferably 35 parts or less based on 100 parts of the base rubber by mass. If the amount of the filler to be blended is less than 2 parts by mass, it becomes difficult to adjust the weight, while if it is more than 50 parts by mass, the weight ratio of the rubber component becomes small and the resilience tends to be lowered.

As the core rubber composition, an organic sulfur compound, an antioxidant or a peptizing agent may be blended appropriately in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide, a mono-substituted diphenyl disulfide such as bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; a di-substituted diphenyl disulfide such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; a tri-substituted diphenyl disulfide such as bis(2,4,6-trichlorophenyl)disulfide, and bis(2-cyano-4-chloro-6-bromophenyl)disulfide; a tetra-substituted diphenyl disulfide such as bis(2,3,5,6-tetra chlorophenyl)disulfide; a penta-substituted diphenyl disulfide such as bis(2,3,4,5,6-pentachlorophenyl)disulfide and bis(2,3,4,5,6-pentabromophenyl)disulfide. These diphenyl disulfides or the derivative thereof can enhance resilience by having some influence on the state of vulcanization of vulcanized rubber. Among them, diphenyl disulfide and bis(pentabromophenyl)disulfide are preferably used since a golf ball having particularly high resilience can be obtained. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the peptizing agent is preferably 0.1 part or more and is preferably 5 parts or less based on 100 parts of the base rubber by mass.

The center can be obtained by mixing, kneading and molding the above rubber composition in the molds. The conditions for molding the rubber composition should be determined depending on the rubber composition. The molding is preferably carried out for 10 to 60 minutes at the temperature of 130 to 180° C. at the pressure from 2.9 MPa to 11.8 MPa. More preferably, the molding is carried out in a two-step heating, for example, for 20 to 40 minutes at the temperature of 130 to 150° C., and continuously for 5 to 15 minutes at the temperature of 160 to 180° C.

The center preferably has a diameter of 35 mm or larger, more preferably 35.5 mm or larger, and preferably has a diameter of 41 mm or smaller, more preferably 40.5 or smaller. If the diameter of the center is smaller than 35 mm, the thickness of the intermediate layer or the cover needs to be thicker than a desired thickness, resulting in the reduction of the golf ball's resilience. On the other hand, if the diameter of the center is larger than 41 mm, the thickness of the intermediate layer or the cover needs to be thinner than the desired thickness, and the intermediate layer or the cover may not function sufficiently.

The intermediate layer includes, for example, a thermoplastic resin such as an ionomer resin, a polyurethane resin, nylon and polyethylene, and a thermoplastic elastomer such as a polystyrene elastomer, a polyolefin elastomer, a polyurethane elastomer, and a polyester elastomer; or a rubber composition such as the rubber composition for the core. The thermoplastic resin and the thermoplastic elastomer can be used solely or in combination of at least two of them. Among them, the ionomer resin is preferable because it can easily increase the hardness of the intermediate layer to provide the core with an "outer-hard and inner-soft" structure.

When the intermediate layer contains an ionomer resin, the content of the ionomer resin in the resin component constituting the intermediate layer is preferably 80 mass % or higher, more preferably 85 mass % or higher, even more preferably 90 mass % or higher. It is also preferable that the resin component of the intermediate layer essentially consists of an ionomer resin.

Examples of the ionomer resin include an ionomer resin prepared by neutralizing at least a part of carboxyl groups in a copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof.

Specific examples of the ionomer resins include, but not limited to, Himilan 1555 (Na), Himilan 1557 (Zn), Himilan 1605 (Na), Himilan 1706 (Zn), Himilan 1707(Na), Himilan AM7311 (Mg), and examples of the ternary copolymer ionomer resin include Himilan 1856 (Na) and Himilan 1855 (Zn) available from MITSUI-DUPONT POLYCHEMICAL CO., LTD.

Further, ionomer resins available from DUPONT CO. include Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li), and examples of the ternary copolymer ionomer resin include Surlyn 8120 (Na), Surlyn 8320 (Na), Surlyn 9320 (Zn), and Surlyn 6320 (Mg).

Ionomer resins such as Iotek 8000 (Na), Iotek 8030 (Na), Iotek 7010 (Zn), and Iotek 7030 (Zn) are available from Exxon Co. Examples of the ternary copolymer ionomer resin include Iotek 7510 (Zn) and Iotek 7520 (Zn). The ionomer resins exemplified above can be used alone, or as a mixture of two or more.

Na, Zn, K, Li, or Mg described in the parentheses after the commercial name of the ionomer resin represents a kind of metal used for neutralization.

The intermediate layer of the golf ball of the present invention may contain a reinforcing material, a pigment component such as titanium oxide or a blue color pigment, a specific gravity adjustment agent such as calcium carbonate and barium sulfate, a dispersant, an anti-oxidant, a ultraviolet absorbent, a light stabilizer, a fluorescent material, a fluorescent brightener, and the like, besides the resin component or the rubber composition, to an extent that the desired properties are not deteriorated. Examples of the reinforcing material include needle-like or Tetrapod (registered trademark)-shaped zinc oxide; a fibrous aluminum borate whisker; a short fiber such as a glass fiber, a carbon fiber, an aramid fiber, or a metal fiber; a nano-filler such as hydrotalcite, octosilicate, and the like.

The intermediate layer of the golf ball of the present invention preferably has a slab hardness in shore D hardness of 50 or larger, more preferably 55 or larger, and even more preferably 60 or larger, and preferably has a slab hardness of 75 or smaller, more preferably 74 or smaller, and even more preferably 73 or smaller. Making the slab hardness of the intermediate layer equal to or larger than 50 in shore D hardness can increase the "outer-hardness and inner-softness" level of the core, thereby providing a high launch angle and a low spin rate and hence achieving a large flight distance of the gold ball. On the other hand, making the slab hardness of the intermediate layer equal to or smaller than 75 in shore D hardness provides an excellent shot feeling, and improves the spin performance of the golf ball, thereby improving the controllability of the golf ball. Here, the slab hardness of the intermediate layer is the measured hardness of a sheet of the intermediate layer composition, and measured by a later-described method. Further, the slab hardness of the intermediate layer can be adjusted, for example, by appropriately selecting a combination of the above resin component or the rubber composition and the amount of an additive.

The intermediate layer is formed, for example, by covering the center with the intermediate layer composition. An embodiment for molding the intermediate layer is not particularly limited, and includes an embodiment which comprises injection molding the intermediate layer composition directly onto the center, or an embodiment which comprises molding the intermediate layer composition into a half hollow-shell, covering the center with the two hollow-shells and subjecting the center with the two hollow shells to the compression-molding for 1 to 5 minutes at the temperature of 130° C. to 170° C.

In a preferable embodiment, the intermediate layer is preferably formed from a resin composition contains the resin as a main component (50 mass % or more). In the case that the core used for the present invention consists of a center and a multi-piece or multi-layer of the intermediate layers covering the center, the intermediate layer in contact with the cover is preferably formed from the resin composition containing the resin as a main component (50 mass % or more). It is also preferable that multi-piece or multi-layer of the intermediate layers are all formed from the resin composition.

In the case that the intermediate layer composition contains the resin as a main component (50 mass % or more), the thickness of the intermediate layer formed from the intermediate layer composition is preferably be 0.5 mm or more, preferably 0.7 mm or more, more preferably 0.9 mm or more and is preferably 2.3 mm or less, more preferably 2.1 mm or less, and even more preferably 1.9 mm or less. Making the thickness of the intermediate layer equal to or less than 2.3 mm, provides an excellent shot feeling. Making the thickness of the intermediate layer equal to or larger than 0.5 mm enhances the effect of the outer-hardness and inner-softness structure, thereby suppressing an excess of the spin rate at the driver shot.

The golf ball of the present invention is not particularly limited, as long as it has a core consisting of a center and at least one intermediate layer covering the center and a cover covering the core. As the structure of the golf ball of the present invention, it may be a three-piece golf ball having a core consisting of a center and a single intermediate layer covering the center, and the cover covering the core; a four-piece golf ball having a core consisting of a center and two intermediate layers covering the center, and the cover covering the core; a multi-piece golf ball having a core consisting of a center and multi-piece or multi-layer of the intermediate layers covering the center, and a cover covering the core. Among them, the present invention can be preferably applied to the three-piece golf ball having a core consisting of a center and a single layered intermediate layer covering the center, and a cover covering the core.

In the case that the golf ball of the present invention has a diameter from 42.5 mm to 43.0 mm, a compression deformation amount (shrinking deformation amount of the golf ball along the compression direction) of the golf ball when applying a load from 98 N as an initial load to 1275 N as a final load is preferably 1.8 mm or more, more preferably 2.0 mm or more, even more preferably 2.2 mm or more, and is preferably 3.4 mm or less, more preferably 3.1 mm or less, even more preferably 2.8 mm or less. If the compression deformation amount is 1.4 mm or more, the shot feeling becomes good, and if the compression deformation amount is larger than 3.4 mm or less, the resilience of the golf ball becomes good.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Methods]

(1) Slab Hardness (Shore D Hardness)

Using the cover composition or the intermediate layer composition, a sheet having a thickness of about 2 mm were prepared by hot press molding and preserved at the temperature of 23° C. for two weeks. Three or more of the sheets were stacked on one another to avoid being affected by the measuring substrate on which the sheets were placed, and the stack was subjected to the measurement using P1 type auto hardness tester provided with the Shore D type spring hardness tester prescribed by ASTM-D2240, available from KOUBUNSHI KEIKI CO., LTD to obtain the respective slab hardness of the cover composition or the intermediate layer composition (2) Core Hardness (JIS-C Hardness)

Using the C type spring hardness tester specified by JIS-K 6301, the JIS-C hardness measured at a surface part of the spherical core was determined as the surface hardness of the core.

(3) Compression Deformation Amount (mm)

The compression deformation amount (amount the golf ball shrinks along the compression direction: mm) of the golf balls or the spherical centers was measured when applying a load from 98 N (10 kgf) as an initial load to 1275 N (130 kgf) as a final load to the golf balls or the centers.

(4) Durability

Each golf ball was repeatedly hit with a metal head driver (#W1 manufactured by SRI Sports Ltd, XXIO) attached to a swing robot M/C manufactured by Golf Laboratories, at the head speed of 45 m/sec. Times up to which the golf balls are cracked were measured. In addition, each value obtained was reduced to an index number relative to the measured value obtained in Golf ball No. 6 being assumed 100. The larger number indicates better durability.

(5) Wear-Resistance 2,500 g of grinding stones (product name "AT", model number 3 available from Tipton Corp.) and 2500 ml of water were put into a ball mill with a volume of 7 L, and 40 to 50 golf balls were put therein. The ball mill was rotated at 50 rpm for 8 hours to perform a wear-resistance test.

Dimple volume of the golf balls after the wear-resistance test was measured, and a dimple volume decrease rate was calculated using the following mathematical expression 1.

Dimple volume decrease rate (%)=((dimple volume before wear-resistance test−dimple volume after wear-resistance test)/dimple volume before wear-resistance test)×100 [Mathematical Expression 1]

(6) Abrasion-Resistance

A commercially available Approach club (SRI sports, Ltd, XXIO, SW shaft S) was installed on a swing robot available from Golf Laboratories, Inc., and 20 golf balls were hit for each golf ball at the head speed of 36 m/sec. to observe the areas which were hit. Abrasion-resistance was evaluated and ranked into four levels based on following criteria.

E (Excellent): Almost no scratch was present on the surface of the golf ball.

G (Good): Slight scratches were present on the surface of the golf ball, but were not conspicuous.

F (Fair): Scratches were conspicuous, and scuffing could be observed.

P (Poor): The surface of the golf ball was abraded considerably, and scuffing was conspicuous.

(7) Shot Feeling

An actual hitting test was carried out by ten golfers using a number 1 wood (#W1 driver), and evaluation was categorized into the following criteria depending on the number of golfers who answered "the golf ball has a small impact, a good resilience, and a excellent shot feeling".

E (Excellent): 8 out of 10 golfers answered that a shot feeling was excellent.

G (Good): 6 or 7 out of 10 golfers answered that a shot feeling was excellent.

F (Fair): 4 or 5 out of 10 golfers answered that a shot feeling was excellent.

P (Poor): 3 or less out of 10 golfers answered that a shot feeling was excellent.

(8) Shot with a Driver

A W #1 driver with a metal head (manufactured by SRI Sports Ltd, SRIXON W505, S shaft, loft 8.5°) was attached to a swing robot M/C manufactured by Golf Laboratories, Inc. and respective golf balls were hit at the head speed of 50 m/second to measure the spin rate (rpm) right after hitting, and the flight distance (distance (m) from the launching point to the stop point). The measurement was carried out 10 times for each golf ball and the average value was defined as the flight distance. The spin rate and the initial ball speed of the golf ball right after the hitting were measured by continuously taking pictures of the hit golf ball.

(9) Shot with an Approach Wedge

An approach wedge (SRIXON I-302, manufactured by SRI Sports) was attached to a swing robot M/C manufactured by Golf Laboratory. Each golf ball was hit at the head speed of 21 m/second, the spin rate (rpm) was measured by continuously taking a photograph of the shot golf ball. The measurement was carried out 10 times for each golf ball and the average value was defined as the spin rate.

[Preparation of Golf Ball]

(1) Preparation of Center

The rubber compositions shown in Table 1 were kneaded and pressed with upper and lower molds each having a spherical cavity at the heating condition of 170° C. for 18 minutes to obtain the spherical center. The amount of Barium sulfate was adjusted to make a golf ball have a mass of 45.6 g.

TABLE 1

| | Center composition No. | | |
|---|---|---|---|
| | 1 | 2 | 3 |
| BR730 | 100 | 100 | 100 |
| Zinc acrylate | 30 | 34 | 38 |
| Zinc oxide | 5 | 5 | 5 |
| Barium sulfate | Proper amount*) | Proper amount*) | Proper amount*) |
| Diphenyl disulfide | 0.5 | 0.5 | 0.5 |
| Dicumyl peroxide | 0.7 | 0.7 | 0.7 |

Notes on Table 1

Formulation: mass part

*)Adjusted to give golf ball weight of 45.6 g depending on the cover composition and the intermediate layer composition.

BR730: High cis-Polybutadiene rubber (cis-content 96% or more) manufactured by JSR Corporation Zinc acrylate: "ZNDA-90S" manufactured by NIHON JYORYU KOGYO Co,. LTD.

Zinc oxide: "Ginrei R" manufactured by Toho-Zinc Co.

Barium sulfate: barium sulfate BD manufactured by Sakai Chemical Industry Co. Ltd.

Dicumyl peroxide: "Percumyl D" manufactured by NOF Corporation

Diphenyl disulfide: manufactured by Sumitomo Seika Chemicals Company Limited

Next, materials shown in Table 2 were mixed by a twin-screw kneading extruder to prepare an intermediate layer composition in the form of pellet. Extrusion was performed in the following conditions: screw diameter=45 mm; screw revolutions=200 rpm; and screw L/D=35. The mixture was heated to a temperature ranging from 150° C. to 230° C. at a die position of the extruder. The obtained intermediate layer composition was injection-molded on the center which had been obtained as described above, to prepare a core consisting of the center and the intermediate layer covering the center.

TABLE 2

| | Intermediate layer Composition No. | | | |
|---|---|---|---|---|
| | 1 | 2 | 3 | 4 |
| HIMILAN 1605 | 5 | 50 | — | — |
| HIMILAN AM7329 | — | 50 | — | — |
| HIMILAN 1855 | 55 | — | — | 45 |
| Surlyn 6320 | 30 | — | — | — |
| Surlyn 8140 | — | — | 50 | — |
| Surlyn 9120 | — | — | 50 | — |

TABLE 2-continued

| | Intermediate layer Composition No. | | | |
|---|---|---|---|---|
| | 1 | 2 | 3 | 4 |
| Rabalon T3339C | — | — | — | 20 |
| HIMILAN 1555 | 10 | — | — | 35 |
| Titanium oxide | 4 | 4 | 4 | 4 |

Note on table 2

Formulation: mass part

Himilan 1605: sodium ion-neutralized ethylene-methacrylic acid copolymerized ionomer resin manufactured by MITSUI-DUPONT POLYCHEMICAL CO., LTD.
Himilan AM7329: zinc ion-neutralized ethylene-methacrylic acid copolymerized ionomer resin manufactured by MITSUI-DUPONT POLYCHEMICAL CO., LTD.
Himilan 1855: zinc ion-neutralized ethylene-methacrylic acid copolymerized ionomer resin manufactured by MITSUI-DUPONT POLYCHEMICAL CO., LTD.
Surlyn 6320: magnesium ion-neutralized ethylene-methacrylic acid copolymerized ionomer resin manufactured by DUPONT CO.
Surlyn 8140: sodium ion-neutralized ethylene-methacrylic acid copolymerized ionomer resin manufactured by DUPONT CO.
Surlyn 9120: zinc ion-neutralized ethylene-methacrylic acid copolymerized ionomer resin manufactured by DUPONT CO.
Rabalon T3339C: polystyrene elastomer manufactured by Mitsui Chemicals, Inc.
Himilan 1555: sodium ion-neutralized ethylene-methacrylic acid copolymerized ionomer resin manufactured by MITSUI-DUPONT POLYCHEMICAL CO., LTD.

(2) Preparation of the Cover Composition

The thermoplastic polyurethane (A), the polyisocyanate compound (B), the polyhydroxyether (C), and a filler for the cover (titanium dioxide) were dry-blended using a tumbler mixer to prepare cover compositions shown in Table 4.

(3) Production of the Golf Ball Body

The cover composition obtained above was injection-molded on the core obtained above to form a cover layer, thereby producing a three-piece golf ball body. Upper and lower molds for forming the cover each have a spherical cavity with pimples, and a part of the pimples serves as a hold pin which is extendable and retractable. The hold pins were protruded to hold the core, resin heated to a temperature of 210° C. was charged into the mold under a pressure of 80 ton for 0.3 seconds, and cooled for 30 seconds. Then, the mold was opened, and the golf ball body was taken out therefrom.

The surface of the obtained golf ball body was subjected to a sandblast treatment and marking, and then clear paint was applied thereto and dried in an oven at a temperature of 40° C. for 4 hours to obtain a golf ball having a diameter of 42.8 mm and a weight of 45.4 g.

Figure 2:
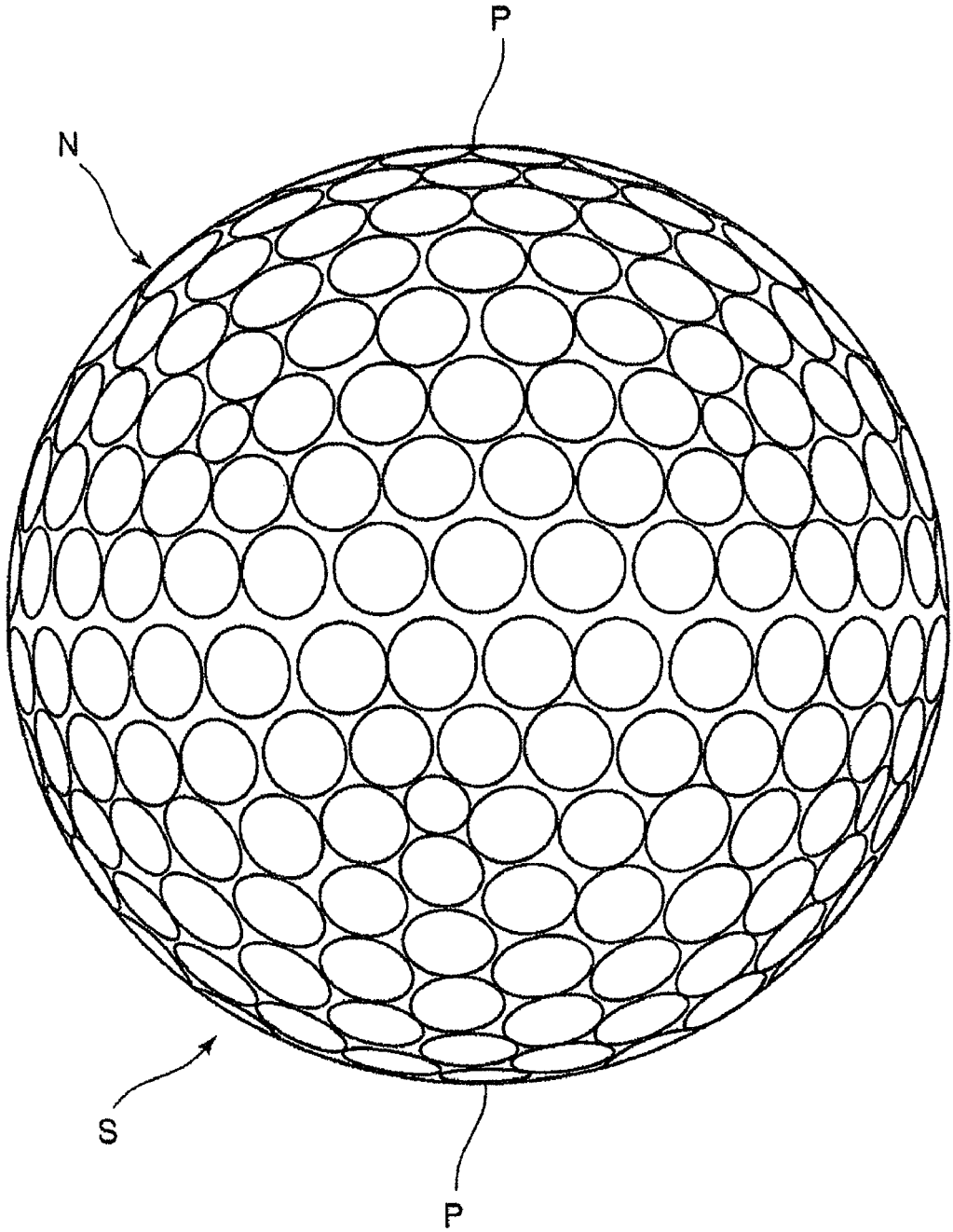
FIG. 2 is a front view of a dimple pattern formed on the surface of the golf ball.
Figure 3:
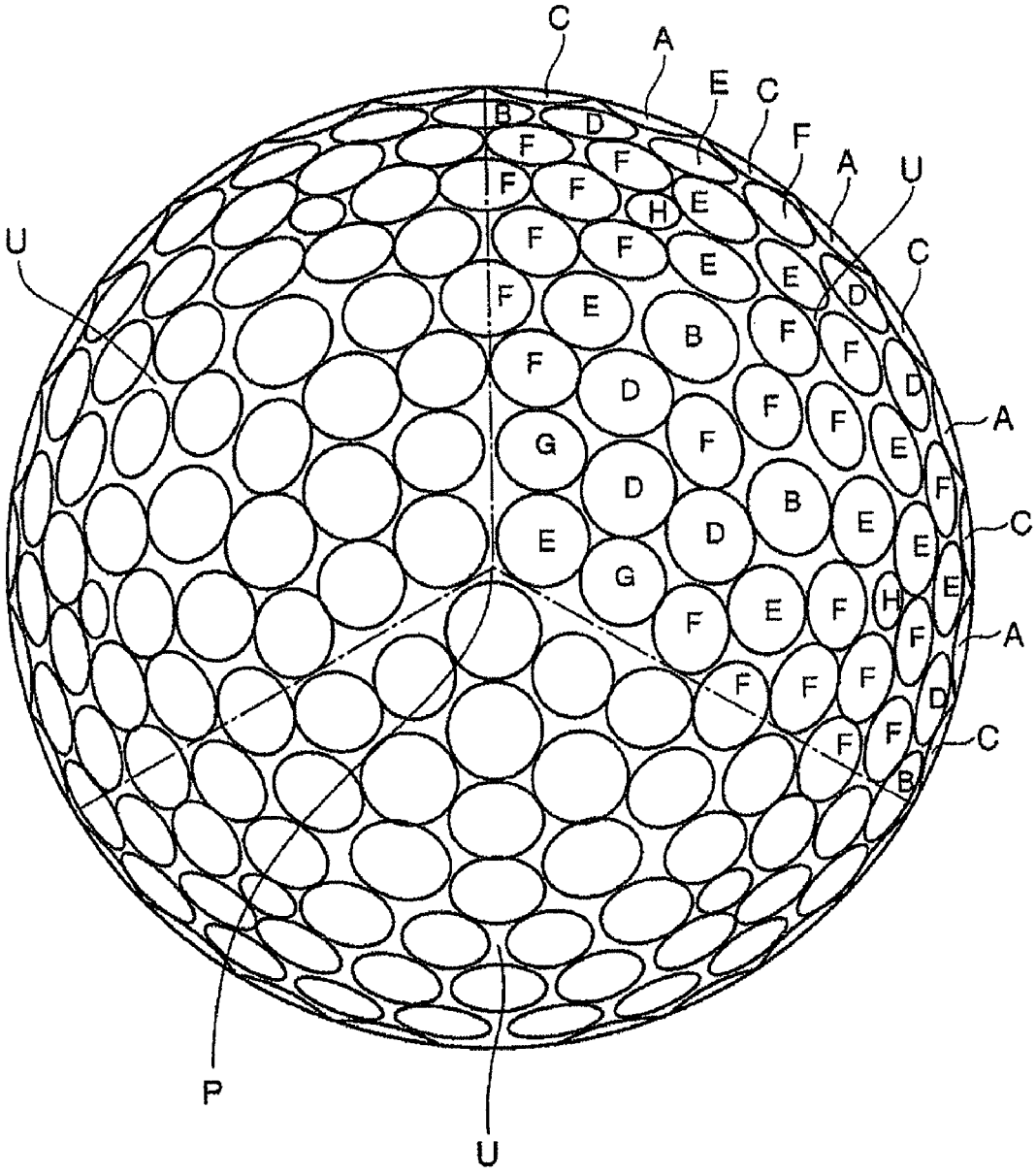
FIG. 3 is a plan view of the dimple pattern formed on the surface of the golf ball.

The golf ball has a dimple pattern shown in Table 3 and FIGS. 2 and 3 on the surface thereof. The northern hemisphere N and the southern hemisphere S of the golf ball each have three units U which are 120 degrees rotation-symmetrical to each other. A total number of dimples formed on the surface of the golf ball was 330, a total volume of the dimples was 311 $mm^3$, and an occupancy ratio was 81.2%. In FIG. 3, types of the dimples only in one unit are indicated by reference characters A to H.

TABLE 3

| Type | Number of dimples | Diameter (mm) | Depth (mm) | Radius of curvature (mm) | Volume ($mm^3$) |
|---|---|---|---|---|---|
| A | 24 | 4.75 | 0.140 | 20.22 | 1.242 |
| B | 18 | 4.65 | 0.140 | 19.38 | 1.190 |
| C | 30 | 4.55 | 0.135 | 19.24 | 1.099 |
| D | 42 | 4.45 | 0.135 | 18.40 | 1.051 |
| E | 66 | 4.25 | 0.135 | 16.79 | 0.959 |
| F | 126 | 4.05 | 0.130 | 15.84 | 0.839 |
| G | 12 | 3.95 | 0.130 | 15.07 | 0.798 |
| H | 12 | 2.80 | 0.120 | 8.23 | 0.370 |

Table 4 shows the compositions and the evaluation regarding durability, wear-resistance and other factors, of the resulting golf balls.

TABLE 4

| | | | Golf ball No. | | | | |
|---|---|---|---|---|---|---|---|
| | | | 1 | 2 | 3 | 4 | 5 |
| Core | Center | Center Composition No. | 2 | 3 | 1 | 2 | 3 |
| | | Diameter (mm) | 38.3 | 39.5 | 39.9 | 37.5 | 37.5 |
| | | Deformation amount (mm) | 3.2 | 2.6 | 3.8 | 3.2 | 2.6 |
| | | Surface hardness (JIS-C) | 82 | 85 | 79 | 82 | 85 |
| | Intermediate layer | Inner interlayer composition No. | 1 | 2 | 3 | 2 | 1 |
| | | Thickness (mm) | 0.8 | 1.0 | 1.2 | 2.2 | 1.0 |
| | | Slab hardness (Shore D) | 52 | 65 | 68 | 65 | 52 |
| | | Outer interlayer Composition No. | — | — | — | — | 3 |
| | | Thickness (mm) | — | — | — | — | 1.1 |
| | | Slab hardness (Shore D) | — | — | — | — | 68 |
| | Cover | (A) Elastollan 1195ATR | 100 | 100 | — | 100 | 100 |
| | | (A) Elastollan ET880 | — | | 100 | — | — |
| | | (A) Elastollan ET858D | — | | — | — | — |
| | | Himilan 1555 | — | — | — | — | — |
| | | Himilan 1557 | — | — | — | — | — |
| | | (C) Polyhydroxyether | 5 | 3 | 5 | 1 | 5 |
| | | (B + b) Polyisocyanate mixture | 10 | 5 | 10 | 2 | 10 |
| | | Titanium oxide | 4 | 4 | 4 | 4 | 4 |
| | | Thickness (mm) | 1.4 | 0.6 | 0.2 | 0.4 | 0.5 |
| | | Slab hardness (Shore D) | 48 | 47 | 26 | 47 | 48 |
| Golf ball Properties | | Durability | 110 | 103 | 120 | 101 | 106 |
| | | Deformation amount (mm) | 3.0 | 2.3 | 3.3 | 2.5 | 2.1 |
| | | Wear-resistance | 4 | 5 | 3 | 6 | 4 |
| | | Abrasion-resistance | G | G | G | G | G |
| | | Shot feeling | G | G | E | G | G |
| | | Spin rate (rpm: driver shot) | 2400 | 2250 | 2200 | 2150 | 2200 |
| | | Distance (m: driver shot) | 276.5 | 278.0 | 227.0 | 278.5 | 279.0 |
| | | Spin rate (rpm, approach club) | 6400 | 6300 | 6500 | 6150 | 6250 |

TABLE 4-continued

| | | Golf ball No. | | | | | |
|---|---|---|---|---|---|---|---|
| | | 6 | 7 | 8 | 9 | 10 | 11 |
| Core Center | Center Composition No. | 2 | 3 | 1 | 3 | 1 | 2 |
| | Diameter (mm) | 37.9 | 39.1 | 34.1 | 39.9 | 36.5 | 39.3 |
| | Deformation amount (mm) | 3.2 | 2.6 | 3.8 | 2.6 | 3.8 | 3.2 |
| | Surface hardness (JIS-C) | 82 | 85 | 79 | 85 | 79 | 82 |
| Intermediate layer | Inner interlayer composition No. | 2 | 1 | 2 | 4 | 2 | 2 |
| | Thickness (mm) | 1.6 | 1.1 | 2.5 | 0.9 | 1.5 | 1.2 |
| | Slab hardness (Shore D) | 65 | 52 | 65 | 48 | 65 | 65 |
| | Outer interlayer Composition No. | — | — | — | — | — | — |
| | Thickness (mm) | — | — | — | — | — | — |
| | Slab hardness (Shore D) | — | — | — | — | — | — |
| Cover | (A) Elastollan 1195ATR | 100 | 100 | — | 100 | 100 | — |
| | (A) Elastollan ET880 | — | | — | — | — | — |
| | (A) Elastollan ET858D | — | | — | — | — | 100 |
| | Himilan 1555 | — | — | 50 | — | — | — |
| | Himilan 1557 | — | — | 50 | — | — | — |
| | (C) Polyhydroxyether | — | — | — | — | 3 | 5 |
| | (B + b) Polyisocyanate mixture | — | 5 | — | — | 5 | 10 |
| | Titanium oxide | 4 | 4 | 4 | 4 | 4 | 4 |
| | Thickness (mm) | 0.8 | 0.7 | 1.8 | 0.5 | 1.6 | 0.5 |
| | Slab hardness (Shore D) | 47 | 47 | 58 | 47 | 47 | 59 |
| Golf ball Properties | Durability | 100 | 102 | 75 | 97 | 98 | 90 |
| | Deformation amount (mm) | 2.7 | 2.4 | 2.9 | 2.4 | 3.5 | 2.7 |
| | Wear-resistance | 9 | 8 | 28 | 9 | 4 | 2 |
| | Abrasion-resistance | P | F | P | P | G | G |
| | Shot feeling | G | F | P | G | G | E |
| | Spin rate (rpm: driver shot) | 2300 | 2450 | 2350 | 2400 | 2380 | 2300 |
| | Distance (m: driver shot) | 276.8 | 276.0 | 276.2 | 276.5 | 275.5 | 276.8 |
| | Spin rate (rpm, approach club) | 6200 | 6250 | 5950 | 6100 | 6350 | 5850 |

Formulation: parts by mass

Notes on Table 4

Elastollan 1195ATR: an MDI-based thermoplastic polyurethane (Shore A hardness 95) available from BASF Japan Ltd.

Elastollan ET880: a thermoplastic polyurethane (Shore A hardness 80) available from BASF Japan Ltd.

Elastollan ET858D: a thermoplastic polyurethane (Shore A hardness 58) available from BASF Japan Ltd.

Himilan 1555: sodium ion-neutralized ethylene-methacrylic acid copolymerized ionomer resin manufactured by MITSUI-DUPONT POLYCHEMICAL CO., LTD.

Himilan 1557: zinc ion-neutralized ethylene-methacrylic acid copolymerized ionomer resin manufactured by MITSUI-DUPONT POLYCHEMICAL CO., LTD.

(C) Polyhydroxyether: Epikote 1256, an epoxy resin (phenoxy-type, weight average molecular weight: about 50000, epoxy equivalent: 7000-8000 g/eq) available from Japan Epoxy Resins Co., Ltd.

(B + b) Polyisocyanate mixture: Crossnate EM-30, a product, in which MDI is dispersed in thermoplastic polyester resin (MDI content: 30 mass %), available from Dainichiseika Color & Chemicals Mfg. Co., Ltd.

In the Golf balls Nos. 1 to 5, the cover is formed from a cover composition containing a thermoplastic polyurethane (A), a polyisocyanate compound (B) having at least two isocyanate groups, and a polyhydroxyether (C) as resin component, wherein the cover composition has a slab hardness from 20 to 55 in shore D hardness, and wherein the cover has a thickness from 0.1 mm to 1.5 mm.

These golf balls Nos. 1 to 5 are superior in durability, wear-resistance, shot feeling, and spin performance to a golf ball No. 6 containing only thermoplastic polyurethane (A) as a resin component. Since the golf ball No. 1 has a slightly thick cover, the spin rate tends to be slightly higher when hitting a driver shot.

The golf ball No. 7 is the case that the cover composition contains, as a resin component, the thermoplastic polyurethane (A) and the polyisocyanate compound (B) having at least two isocyanate groups. The durability and wear-resistance was improved but the abrasion-resistance and shot feeling were inferior as compared with the golf ball No. 6. The golf ball No. 8 containing the ionomer resin as a resin component is inferior in durability, wear-resistance, abrasion-resistance, and shot feeling as compared with the golf ball No. 6. The golf ball No. 9 is the case that the cover composition contains only the thermoplastic polyurethane (A) as a resin component, and the intermediate layer thereof has a slab hardness of not more than 50 in shore D hardness. The golf ball No. 9 is inferior in durability to the golf ball No. 6.

The golf ball No. 10 is the case that the cover has a thickness larger than 1.5 mm. The durability was inferior and the spin rate thereof tended to be higher when hitting a driver shot, as compared with the golf ball No. 6. The golf ball No. 11 is the case that the cover has a slab hardness larger than 55 in shore D hardness. The durability was inferior and the spin rate thereof tended to be lower when hitting an approach shot with an approach wedge as compared with the golf ball No. 6.

The present invention is applicable to a golf ball having a urethane cover, and in particular, suitable for improving durability, wear-resistance, and spin performance. This application is based on Japanese Patent application Nos. 2007-341234 filed on Dec. 28, 2007, the contents of which are hereby incorporated by reference.

What is claimed is:

1. A golf ball comprising:

a core consisting of a center and at least one intermediate layer covering the center; and a cover covering the core, wherein the cover is formed from a cover composition containing a thermoplastic polyurethane (A), a polyisocyanate compound (B) having at least two isocyanate groups, and a polyhydroxyether (C) as a resin component, wherein the cover composition has a slab hardness from 20 to 55 in shore D hardness, the cover has a thickness from 0.1 mm to 1.5 mm, and the polyhydroxyether (C) has a repeating structural unit represented by Formula (1):

(1)

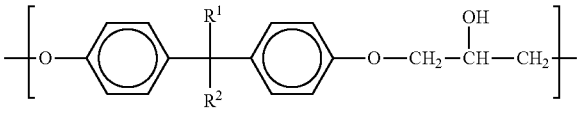

wherein $R^1$ and $R^2$ are the same or different from each other, and each are a hydrogen atom or a methyl group.

2. The golf ball according to claim 1, wherein the polyhydroxyether (C) is represented by Formula (2):

(2)

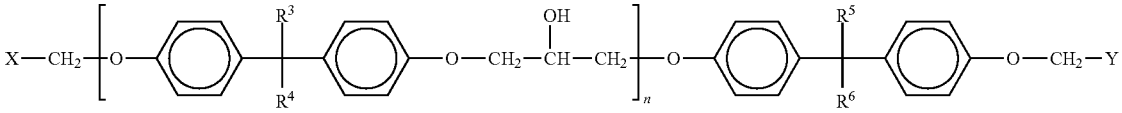

wherein $R^3$, $R^4$, $R^5$, $R^6$ are the same or different from each other, and each are a hydrogen atom or a methyl group; X and Y are the same or different from each other, and each are an epoxy group or a hydroxyethyl group; and n is a positive integer.

3. The golf ball according to claim 1, wherein the polyhydroxyether (C) has a number average molecular weight from 100 to 100,000.

(2)

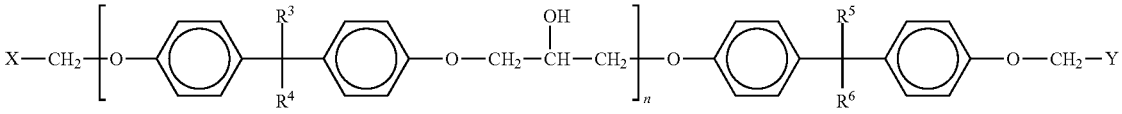

4. The golf ball according to claim 1, wherein the polyhydroxyether (C) is an epoxy resin having an epoxy equivalent ranging from 1,000 g/eq to 20,000 g/eq.

5. The golf ball according to claim 1, wherein the polyhydroxyether (C) is an epoxy resin having a number average molecular weight ranging from 1,000 to 8,000.

6. The golf ball according to claim 1, wherein the polyhydroxyether (C) is a phenoxy resin having a weight average molecular weight ranging from 10,000 to 100,000.

7. The golf ball according to claim 1, wherein an amount of the polyhydroxyether (C) is 1 to 20 parts by mass with respect to 100 parts by mass of the thermoplastic polyurethane (A).

8. The golf ball according to claim 1, wherein the polyisocyanate (B) is a polyisocyanate mixture (B+b) where the polyisocyanate (B) is dispersed into a thermoplastic resin (b) which does not substantially react with an isocyanate group.

9. The golf ball according to claim 1, wherein the intermediate layer in contact with the cover is formed from a resin composition.

10. The golf ball according to claim 1, wherein the intermediate layer in contact with the cover has a thickness ranging from 0.5 mm to 2.3 mm.

11. The golf ball according to claim 1, wherein a resin composition forming the intermediate layer in contact with the cover has a slab hardness from 50 to 75 in shore D hardness.

12. A golf ball comprising:

a core consisting of a center and at least one intermediate layer covering the center; and a cover covering the core, wherein the cover is formed from a cover composition containing a thermoplastic polyurethane (A), a polyisocyanate compound (B) having at least two isocyanate groups, and a polyhydroxyether (C) represented by the following formula (2) as a resin component, the cover composition has a slab hardness from 20 to 55 in shore D hardness, and the cover has a thickness from 0.1 mm to 1.5 mm, wherein an intermediate layer in contact with the cover layer is formed from a resin composition which has a slab hardness from 50 to 75 in shore D hardness, and the intermediate layer in contact with the cover has a thickness ranging from 0.5 mm to 2.3 mm

13. The golf ball according to claim 12, wherein the polyhydroxyether (C) has a number average molecular weight from 100 to 100,000.

14. The golf ball according to claim 12, wherein the polyhydroxyether (C) is an epoxy resin having an epoxy equivalent ranging from 1,000 g/eq to 20,000 g/eq.

15. The golf ball according to claim 12, wherein the polyhydroxyether (C) is an epoxy resin having a number average molecular weight ranging from 1,000 to 8,000.

16. The golf ball according to claim 12, wherein the polyhydroxyether (C) is a phenoxy resin having a weight average molecular weight ranging from 10,000 to 100,000.

17. The golf ball according to claim 12, wherein an amount of the polyhydroxyether (C) is 1 to 20 parts by mass with respect to 100 parts by mass of the thermoplastic polyurethane (A).

18. The golf ball according to claim 12, wherein the polyisocyanate (B) is a polyisocyanate mixture (B+b) where the polyisocyanate (B) is dispersed into a thermoplastic resin (b) which does not substantially react with an isocyanate group.

* * * * *